US005254447A

United States Patent [19]

Meyer et al.

[11] Patent Number: 5,254,447

[45] Date of Patent: Oct. 19, 1993

[54] PHOTOGRAPHIC ELEMENTS COMPRISING A GLASS PLATE SUPPORT AND METHOD FOR THEIR MANUFACTURE

[75] Inventors: Arlene L. Meyer, Pittsford; Thomas M. Smith; Richard O. Smith, both of Spencerport, all of N.Y.

[73] Assignee: Eastman Kodak Company, Rochester, N.Y.

[21] Appl. No.: 871,869

[22] Filed: Apr. 20, 1992

[51] Int. Cl.[5] ..... G03C 1/815

[52] U.S. Cl. ..... 430/510; 430/259; 430/263; 430/517; 430/523; 430/950; 156/230; 156/238; 156/247; 428/40; 428/41; 428/46; 428/345

[58] Field of Search ..... 430/523, 510, 950, 961, 430/517, 259, 263, 918; 156/230, 238, 249, 309; 428/40, 41, 46, 345, 354, 906, 913

[56] References Cited

U.S. PATENT DOCUMENTS

| | | | |
|---|---|---|---|
| 4,033,290 | 7/1971 | Dude . | |
| 4,077,830 | 3/1978 | Fulwiler . | |
| 4,337,107 | 6/1982 | Eshleman . | |
| 4,378,392 | 3/1983 | Segel . | |
| 4,403,031 | 9/1983 | Borrelli et al. | 430/335 |
| 4,581,267 | 4/1986 | Miller . | |
| 4,587,199 | 5/1986 | Bennett | 430/523 |
| 4,891,296 | 1/1990 | Tsukukiri et al. | 430/523 |
| 4,894,303 | 1/1990 | Wu | 430/523 |
| 5,085,907 | 2/1992 | Smith . | |

*Primary Examiner*—Jack P. Brammer

*Attorney, Agent, or Firm*—Alfred P. Lorenzo

[57] ABSTRACT

Photographic glass plates are advantageously prepared by a process in which the functional layers are applied to the glass plate support by lamination. In a first form of this process, a multilayer-composite comprising antihalation, silver halide emulsion and protective overcoat layers is transferred from a flexible polymeric film support to the glass support. In carrying out this first form of the process, a release layer, protective overcoat layer, silver halide emulsion layer and antihalation layer are coated, in order, on a flexible polymeric film and laminated via an adhesive layer to a glass plate having suitable thickness and flatness for use as a photographic support. The release layer is designed to have greater adhesion to the flexible polymeric film than to the protective overcoat layer, whereby the film and release layer can be stripped off prior to the plate being put into use. In a second form of the process, an antihalation layer, silver halide emulsion layer and protective overcoat layer are coated, in order, on a support material comprised of a release sheet, a very thin polymeric film and an adhesive layer interposed between the release sheet and the film, the release sheet is then stripped away and the remainder of the coated support material is laminated via the adhesive layer to the glass plate support. The process of lamination eliminates the difficult task of directly coating photographic layers on glass plates and greatly facilitates the preparation of high quality photographic glass plates in a wide variety of different sizes.

11 Claims, 2 Drawing Sheets

PHOTOGRAPHIC ELEMENTS COMPRISING A GLASS PLATE SUPPORT AND METHOD FOR THEIR MANUFACTURE

FIELD OF THE INVENTION

This invention relates in general to photography and in particular to the manufacture of photographic elements which utilize a glass plate as a support material. More specifically, this invention relates to photographic glass plates in which the functional layers have been applied to the glass by a process of lamination and to a method for the manufacture of such plates.

BACKGROUND OF THE INVENTION

Photographic elements are coated on a wide variety of support materials, with the three major categories being plastics, paper and glass. Plastics are used as the support when a combination of transparency, strength, dimensional stability and light weight is needed. Useful plastics include cellulose triacetate, cellulose acetate propionate, cellulose acetate butyrate, polystyrene, polycarbonate and polyethylene terephthalate. Paper is the support of choice in situations where the physical property requirements are not too demanding, cost is a major factor or an opaque base is needed. Typically, photographic paper supports are coated on both sides with a thin layer of a polymeric resin such as polyethylene. Glass has the advantages of excellent dimensional stability and extreme flatness but is disadvantageous in that it is expensive, heavy and brittle. Photographic glass plates typically range in thickness from about 1 to about 10 millimeters and are graded by flatness. Those with the lowest degree of flatness are used in such applications as photomicrography and graphic arts, those with an intermediate degree of flatness in such applications as photofabrication, stereoplotters and aerial cameras, and those with the highest degree of flatness in such applications as high-precision stereoplotters, ballistic and aerotriangulation camera systems and special scientific investigations.

The coating of glass plates with photographic layers is a very demanding art since the layers must be extremely thin, highly uniform in thickness, and completely free from defects. One of the most effective techniques for accomplishing such coating is that described in U.S. Pat. No. 4,033,290, issued Jul. 5, 1977, in which a coating system based on wicking action is employed. In this system, an absorption wick having an arcuate surface is utilized in combination with a transfer wick that is in conforming contact with the arcuate surface. The difficulties involved in coating glass plates are described in this patent as follows:

"The coating of photographic glass plates is a very exacting coating operation in view of the stringent requirements that such plates must be capable of meeting. Thus, for example, to be used successfully for the coating of photographic glass plates the coating process must provide (1) complete coverage of the area which is to be coated, i.e., freedom from "skips" which would result in uncoated areas of even miniscule dimensions, (2) a coating layer which is extremely thin, (3) exactly uniform wet coverage, (4) freedom from coated material on the edges of the plate, (5) freedom from streaks or other coating defects, and (6) freedom from contamination with dust or other foreign materials. In addition the process must be capable of handling fragile sheets of glass without damage."

While the method and apparatus of the aforesaid U.S. Pat. No. 4,033,290 represent an important advance in the art of coating photographic glass plates and have proved highly successful, there are still serious concerns associated with their use. For example, there is a continuing need to still further reduce the number of streaks and other coating defects that occur. It would also be very desirable to be able to coat at much higher speeds than those that are attainable with a wick coater. Moreover, since photographic glass plates are needed in a very wide range of different sizes, there are inherent limitations in any coating operation that make it difficult to meet such needs. Thus, for example, a single coating line is not well suited to coating a very wide range of plates of differing widths, but the provision of multiple coating lines in order to have a separate line for each width desired is economically impractical. Yet another critical problem involved in the manufacture of photographic glass plates is the difficulty in providing edge-to-edge uniformity in the thickness of the silver halide emulsion layer.

As an alternative to coating the functional layers on the glass, photographic glass plates have been produced by adhesively securing a conventional radiation-sensitive photographic film to a sheet of glass by means of an adhesive layer interposed between the glass and the film support. The product resulting from such a process comprises a glass support having, in order on one surface thereof, the adhesive layer, the film support material—for example acetate film base or polyester film base—and the silver halide emulsion layer, as well as any other desired functional layers. This method of producing photographic glass plates avoids the problems involved in coating photographic coating compositions on glass. However, photographic film base is typically relatively thick, e.g., in the range of from about 0.1 to about 0.3 millimeters, and may exhibit many minor imperfections and, as a consequence, the optical characteristics of such photographic plates are seriously degraded.

A wide variety of laminate materials have been proposed for use in the photographic art and these laminates can be employed to protect the emulsion layer of photographic glass plates. Examples of such laminates include those disclosed in U.S. Pat. Nos. 4,077,830, 4,337,107, 4,378,392, 4,581,267 and 5,085,907. However, the photographic glass plates utilized in conjunction with such protective laminates have been made by conventional techniques as described hereinabove.

It is toward the objective of providing an improved way of manufacturing photographic glass plates, which provides much greater versatility in operation as well as enhanced product quality, that the present invention is directed.

SUMMARY OF THE INVENTION

In accordance with this invention, photographic glass plates comprising a silver halide emulsion layer are prepared by a process in which the silver halide emulsion layer and any other required functional layers, such as antihalation and protective overcoat layers, are applied to the glass plate support by lamination. (The term "silver halide emulsion layer" as used herein is intended to encompass any radiation-sensitive layer containing silver halide grains.) In a first form of this process, a release layer, a protective overcoat layer, a silver halide emulsion layer and an antihalation layer are coated, in order, on a flexible polymeric film and laminated via an adhesive layer to a glass plate having suitable thickness and flatness for use as a photographic support. The release layer is designed to have greater adhesion to the flexible polymeric film than to the protective overcoat layer, whereby the film and release layer can be stripped off prior to the plate being put into use. Depending on the product requirements, the antihalation layer and/or the protective overcoat layer can be omitted. Also, depending on product requirements, there can be two or more silver halide emulsion layers and additional layers providing other functional characteristics can be included.

In a second form of the process, an element comprising a release sheet, a very thin polymeric film whose thickness is much less than that of the release sheet, and an adhesive layer interposed between the film and the release sheet, is prepared and utilized as a support material on which there is coated, in order, an antihalation layer, a silver halide emulsion layer and a protective overcoat layer. Again, in this form of the process, additional layers can be included and the antihalation layer and/or the protective overcoat layer can be omitted. To prepare a photographic glass plate utilizing this form of the process, the release sheet is stripped away and the remainder of the element is laminated via the adhesive layer to the glass plate.

A key feature of this invention is the use of lamination techniques in photographic glass plate manufacture. The process of lamination eliminates the difficult task of directly coating photographic layers on glass plates and greatly facilitates the preparation of high quality photographic glass plates in a wide variety of different sizes and emulsion types.

Accordingly, in one embodiment, the invention comprises a novel element, useful as a means of transferring a multilayer-composite to a glass plate support in the manufacture of a photographic glass plate, comprising a flexible polymeric film bearing on one surface thereof a multilayer-composite comprising a release layer, a protective overcoat layer, a silver halide emulsion layer and an antihalation layer. In a second embodiment, the invention comprises a glass support bearing in order on one surface thereof an adhesive layer, an antihalation layer, a silver halide emulsion layer and a protective overcoat layer. In a third embodiment, the invention comprises a novel element comprised of a series of layers sandwiched between a rigid glass plate and a flexible polymeric film, the layers comprising, in order, (1) an adhesive layer in contact with the glass plate, (2) an antihalation layer, (3) a silver halide emulsion layer, (4) a protective overcoat layer and (5) a release layer in contact with the flexible polymeric film. In a fourth embodiment, the invention comprises a novel element comprised of a release sheet, a very thin polymeric film whose thickness is much less than that of the release sheet, an adhesive layer interposed between the release sheet and the film, an antihalation layer overlying the very thin film, a silver halide emulsion layer overlying the antihalation layer and a protective overcoat layer overlying the emulsion layer. In a fifth embodiment, the invention comprises a novel photographic plate comprising a glass support bearing in order on one surface thereof an adhesive layer, a very thin polymeric film, an antihalation layer, a silver halide emulsion layer and a protective overcoat layer. Other embodiments of the invention are similar to those described above but can contain fewer layers or more layers depending on product requirements.

As an alternative to the use of a release layer, a flexible polymeric film having a release surface can be employed in the present invention. The release characteristics of the polymer surface can be a result of the composition of the film or the result of surface treatment of the film.

In comparison with the photographic glass plates of the prior art and the known methods for their manufacture, this invention provides many benefits and advantages. Thus, for example, since the photographic coatings are applied to a flexible support material rather than to a rigid glass plate they can be applied by use of the conventional methods and apparatus of the photographic coating art and thus can be coated at much higher speeds, and with far fewer streaks or other coating defects, than can be achieved when photographic coating compositions are coated on a glass plate. Thus, for example, the photographic coatings can be applied to the support material by such high speed methods as the multilayer bead coating process of U.S. Pat. No. 2,761,791 or the multilayer curtain coating process of U.S. Pat. No. 3,508,497. This advantage more than makes up for the added cost and complexity of utilizing an adhesive layer and a laminating step in the process. Moreover, the laminating process is readily adaptable to use with a wide variety of different sizes of glass plate and thus readily accommodates the need for a widely diverse product line. As a further advantage, the risk of damage or breakage to the relatively fragile glass plates is much less in the laminating operation than in a typical coating process. The flexible polymeric film can be removed, via the release layer, after manufacture and prior to packaging. Alternatively, it can be left in place until the photographic plate is placed in use by the customer who can then readily strip it off. This latter approach has the advantage that it serves as a protection against dirt, abrasion and scratching during packaging, shipment and storage. In yet another alternative, the very thin polymeric film is bonded to the glass plate by the adhesive layer to thereby create a product in which the glass plate and polymeric film serve together as the support.

The first form of the process described herein has the advantage that the final product utilizes only the glass plate as the support means so that optimum optical characteristics can be realized. The second form of the process described herein has the advantage that the very thin polymeric film protects the adhesive layer (except at its edges) against attack by processing solutions and thereby reduces the risk of delamination.

BRIEF DESCRIPTION OF THE DRAWINGS

FIG. 3 illustrates that separation occurs between the release layer and the protective overcoat layer when the flexible polymeric film is stripped away prior to use of the photographic plate.

DETAILED DESCRIPTION OF THE INVENTION

Figure 1:
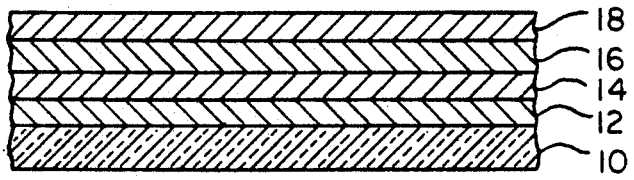
FIG. 1 is a cross-sectional view of an element of this invention comprising a flexible polymeric film bearing on one surface thereof a release layer, a protective overcoat layer, a silver halide emulsion layer and an antihalation layer.

As described hereinabove, the present invention can be utilized in the form of a variety of different embodiments. Common to all such embodiments is a lamination step whereby the photographic layers are united with the rigid glass plate that serves as a highly dimensionally stable support.

The structural components of the sandwich structure specifically described herein are (1) a rigid glass plate, (2) an adhesive layer in contact with the glass plate, (3) an antihalation layer, (4) a silver halide emulsion layer, (5) a protective overcoat layer, (6) a release layer and (7) a flexible polymeric film in contact with the release layer. It is, of course, feasible to include additional layers within this structure, as desired. Thus, for example, two or more silver halide emulsion layers can be employed and additional layers, such as interlayers and/or filter layers can be incorporated in the sandwich.

The antihalation layer, silver halide emulsion layer and protective overcoat layer are referred to herein as "photographic layers", or layers formed from photographic coating compositions, since they each have a photographic function in the end product. On the other hand, the release layer and adhesiver layer do not have such functions and are utilized solely to enable the manufacturing process to be carried out. By use of an appropriate release layer and adhesiver layer, the difficult task of coating photographic coating compositions on glass plates is entirely avoided and a simple technique of lamination can be used in its place. Coating an adhesive layer on a glass plate does not, of course, pose similar problems, because the adhesive layer can have minor skips or coating imperfections and still perform its function in an acceptable manner while the photographic layers, and especially the silver halide emulsion layer, cannot.

Photographic glass plates of the prior art typically have the antihalation layer on the side of the glass support opposite to that on which the emulsion layer is coated. The photographic glass plates of this invention differ from such prior art plates in that they have the antihalation layer on the same side of the glass support as the emulsion layer and in that an adhesive layer is interposed between the glass support and the antihalation layer. The adhesive layer is required because of the laminating process used in their manufacture, whereas prior art photographic glass plates did not require an adhesive layer since the coatings were applied directly to the glass by suitable application techniques, such as the wick coating process of U.S. Pat. No. 4,033,290.

The essential steps of the first form of the manufacturing process of this invention are (1) to coat the release coating composition and photographic coating compositions on one surface of the flexible polymeric film to thereby form a flexible film having on one surface thereof a multilayer composite temporarily adhered to the flexible film by a release layer, (2) to laminate the coated flexible film to a glass plate support by means of an adhesive layer so that the multilayer composite is sandwiched between the flexible film and the glass plate, and (3) to strip away the flexible film and adhering release layer to leave the multilayer composite permanently bonded to the glass plate. Typically, the coatings applied to the flexible film are dried prior to the lamination step using the conventional techniques of drying with air at an elevated temperature that are employed in the photographic art. Application of the release coating composition and the photographic coating compositions to the flexible polymeric film can be carried out in a single step using well known techniques of simultaneous multilayer coating commonly employed in the photographic art. Thus, for example, multilayer bead coating or multilayer curtain coating techniques can be employed. Alternatively, these coatings can be applied in two or more sequential steps with drying taking place between the coating operations. The adhesive coating composition can be applied to the glass plate by suitable coating techniques, such as gravure coating, prior to the lamination step. Alternatively, the adhesive layer can be coated over the antihalation layer on the flexible polymeric film and thereafter the coated film can be laminated to the glass plate.

As hereinabove described, a key feature of the present invention is the use of an adhesive composition to laminate a multilayer composite, as described above, to a glass plate support. Any of a very wide range of well known adhesive compositions can be utilized for this purpose. Useful adhesive include aqueous-based adhesives, solvent-based adhesives and monomeric adhesives. Because of cost and environmental considerations, aqueous-based adhesives are greatly preferred.

Aqueous-based adhesives used in this invention can be of the pressure-sensitive or heat-curable type. Generally, it is preferred to use pressure-sensitive adhesives. The pressure-sensitive adhesive composition can be applied to the glass plate, which has been previously ground and cleaned, and then dried by conventional drying techniques. A suitable dry thickness for the adhesive layer is in the range of from about 2 to about 25 micrometers, and more preferably in the range of from about 5 to about 10 micrometers.

Particularly preferred adhesive compositions for use in this invention are those comprising a film-forming copolymer of methyl vinyl ether and maleic anhydride. These copolymers are well known commercially available materials, sold, for example, under the trademark GANTREZ by GAF CHEMICALS CORPORATION. Examples of suitable copolymers for use in this invention include GANTREZ AN-119 Copolymer, GANTREZ AN-139 Copolymer, GANTREZ AN-149 Copolymer, GANTREZ AN-169 Copolymer and GANTREZ AN-179 Copolymer. The molecular weights of these copolymers range from 20,000 for GANTREZ AN-119 Copolymer to 80,000 for GANTREZ AN-179 Copolymer.

Copolymers of methyl vinyl ether and maleic anhydride can be represented by the formula:

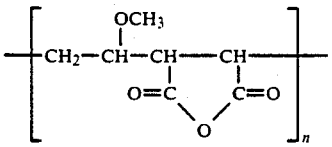

Other particularly effective adhesive compositions for use in this invention are those comprising an acrylic polymer, gelatin or a cyanoacrylate. The particular adhesive used is not critical. However, the adhesive layer must be sufficiently tacky or fluid to achieve transfer yet must have the ability to survive exposure to photographic processing solutions without the occurrence of delamination or other defects.

Examples of preferred adhesive compositions for the purposes of this invention include the following formulations in which all percentages are by weight:

(a)

18% GANTREZ AN-119 copolymer
12% glycerol
70% water (b)

18% CARBOSET XL-52 resin
12% CARBOSET 515 resin
70% water (c)

18% gelatin
12% glycerol
70% water (d)

60% ACRONAL 50-D resin
40% water

CARBOSET XL-52 resin and CARBOSET 515 resin are manufactured by the Specialty Polymers & Chemicals Division of B. F. GOODRICH with CARBOSET XL-52 being an acrylic copolymer with a Tg of +3° C. and CARBOSET 515 being an acrylic copolymer with a Tg of −14° C. ACRONAL 50-D resin is manufactured by BASF CORPORATION, Chemicals Division, and is a 50% solids dispersion in water of an acrylic copolymer with a Tg of −45° C.

Another particularly suitable adhesive is a cyanoacrylate adhesive available under the trademark PERMABOND 102 from NATIONAL STARCH AND CHEMICAL CORPORATION.

A preferred procedure is to gravure coat the adhesive composition on the glass plate. Elevated temperatures of 40° C. to 60° C. are advantageously employed with the adhesive formulation containing gelatin, but room temperature coating is satisfactory for the other adhesive formulations.

A suitable dry thickness for the adhesive layer is in the range of from about 2 to about 25 micrometers and more preferably in the range of from about 5 to about 10 micrometers.

The adhesive layer must adequately bond the other layers to the glass plate prior to, during and after processing of the plate. It should be resistant to attack by processing solutions which penetrate through the overlying functional layers and/or contact the adhesive layer at its edges. Additionally, the adhesive layer should be essentially transparent to radiation of the wavelength used for exposure and produce no adverse sensitometric effects on the photographic layers.

Typically, the glass that is used in this invention has a high degree of flatness and a thickness in the range of from about 1 to about 10 millimeters. The invention is particularly advantageous in the production of large format glass plates, for example, those having a major dimension in excess of 75 centimeters. Large format glass plates are especially difficult to manufacture by prior art techniques, because of the great difficulty of handling glass of such dimensions in a coating operation.

FIG. 1 is a cross-sectional view of an element of this invention comprising a flexible polymeric film 10 bearing on one surface thereof a release layer 12, a protective overcoat layer 14, a silver halide emulsion layer 16 and an antihalation layer 18.

Figure 2:
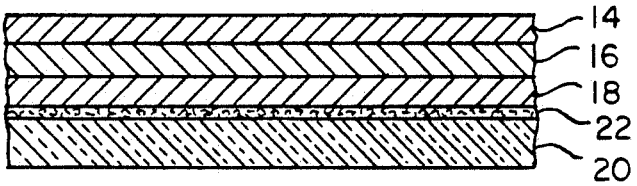
FIG. 2 is a cross-sectional view of an element of this invention comprising a rigid glass plate bearing on one surface thereof an adhesive layer, an antihalation layer, a silver halide emulsion layer, and a protective overcoat layer.

FIG. 2 is a cross-sectional view of an element of this invention comprising a rigid glass plate 20 bearing on one surface thereof an adhesive layer 22, an antihalation layer 18, a silver halide emulsion layer 16 and a protective overcoat layer 14.

Figure 3:
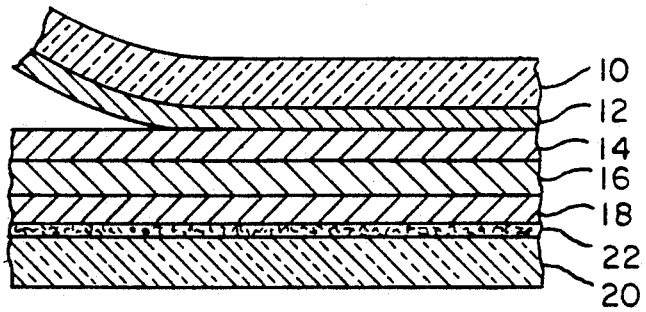
FIG. 3 is a cross-sectional view of an element of this invention comprising a series of layers sandwiched between a rigid glass plate and a flexible polymeric film, the layers comprising, in order, an adhesive layer in contact with the glass plate, an antihalation layer, a silver halide emulsion layer, a protective overcoat layer and a release layer in contact with the polymeric film.

FIG. 3 is a cross-sectional view of an element of this invention comprising a series of layers sandwiched between a rigid glass plate 20 and a flexible polymeric film 10, the layers comprising, in order, an adhesive layer 22 in contact with glass plate 20, an antihalation layer 18, a silver halide emulsion layer 16, a protective overcoat layer 14 and a release layer 12 in contact with polymeric film 10. FIG. 3 illustrates that separation occurs between the release layer 12 and the protective overcoat layer 14 when the flexible polymeric film 10 is stripped away prior to use of the photographic plate.

Figure 4:
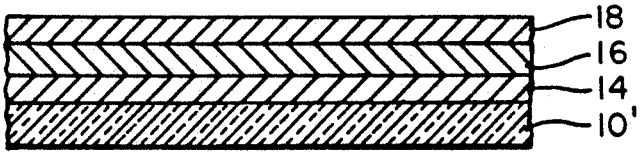
FIG. 4 is a cross-sectional view of an element of this invention comprising a flexible polymeric film having a release surface and bearing on such surface a protective overcoat layer, a silver halide emulsion layer and an antihalation layer.

FIG. 4 is a cross-sectional view of an element of this invention comprising a flexible polymeric film 10' having a release surface and bearing, in order, on such surface a protective overcoat layer 14, a silver halide emulsion layer 16 and an antihalation layer 18.

Figure 5:
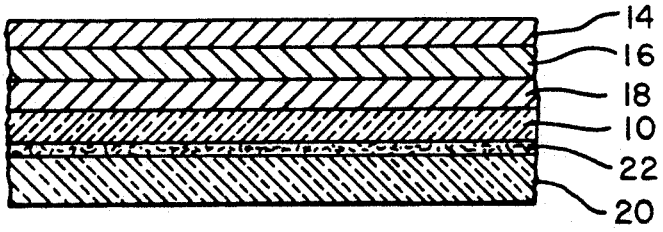
FIG. 5 is a cross-sectional view of an element of this invention comprising a rigid glass plate bearing on one surface thereof an adhesive layer, a very thin polymeric film which protects the adhesive layer, an antihalation layer, a silver halide emulsion layer, and a protective overcoat layer

FIG. 5 is a cross-sectional view of an element of this invention comprising a rigid glass plate 20 bearing on one surface thereof an adhesive layer 22, a very thin polymeric film 10, an antihalation layer 18, a silver halide emulsion layer 16 and a protective overcoat layer 14. FIG. 5 illustrates that embodiment of the invention in which the very thin polymeric film and glass plate are combined together to serve as the support.

One suitable method for the manufacture of a photographic glass plate in accordance with this invention comprises the steps of:

(1) providing a flexible polymeric film;

(2) coating the flexible polymeric film with a series of layers arranged in order thereon, the series of layers comprising a release layer in contact with the flexible polymeric film, a protective overcoat layer, a silver halide emulsion layer and an antihalation layer, the release layer having greater adhesion to the flexible polymeric film than to the protective overcoat layer;

(3) providing a rigid glass plate, (4) laminating the coated flexible polymeric film to the glass plate by means of an adhesive layer so that the antihalation layer is in contact with the adhesive layer; and (5) stripping the flexible polymeric film and adherent release layer from the protective overcoat layer to thereby produce a photographic glass plate comprising a rigid glass support bearing on one surface thereof, in order, the adhesive layer, the antihalation layer, the silver halide emulsion layer and the protective overcoat layer.

Another suitable method for the manufacture of a photographic glass plate in accordance with this invention comprises the steps of:

(1) providing a support material comprised of a release sheet, a very thin polymeric film whose thickness is much less than that of the release sheet and an adhesive layer interposed between the release sheet and the film;

(2) coating the support material with a series of layers arranged in order thereon, the series of layers comprising in order an antihalation layer, a silver halide emulsion layer and a protective overcoat layer;

(3) providing a rigid glass plate;

(4) stripping the release sheet from the coated support material; and (5) laminating the coated support material to the glass plate by means of the adhesive layer, to thereby produce a photographic glass plate comprising a rigid glass support bearing on one surface thereof, in order, the adhesive layer, the very thin polymeric film, the antihalation layer, the silver halide emulsion layer and the protective overcoat layer.

The lamination step in the process of this invention is most effectively carried out using dry lamination techniques employing a pressure-sensitive adhesive layer. However, use of wet-lamination techniques such as with adhesive layers that are subsequently polymerized is also feasible. Typical laminating conditions utilize at least one deformable roller with a Shore A hardness of 55–65 durometers operated at a pressure of about 10 Kg/square centimeter. Both tension and nip forces should be carefully controlled in the lamination process to achieve the desired result of wrinkle-free lamination.

Commercially available laminating equipment can be readily adapted to carry out the laminating process of this invention. For example, a suitable device which can be adapted for this purpose is DuPont's Hot Roll Laminator HRL-24 which is commonly employed for laminating photopolymer film resist.

In a preferred embodiment of the invention, the flexible polymeric film is coated with adhesive on the non-sensitized side and chopped to dimensions which are slightly less than those of the glass plate to which it is to be laminated. In this way, lamination of the polymeric film to the glass plate leaves a border area on the glass plate which is free of adhesive. This reduces the risk of getting adhesive on the edges of the glass plate, avoids the need for trimming, and reduces the risk of delamination occurring during finishing operations.

The flexible polymeric film utilized in this invention can be any of the polymeric film supports known for use in the photographic arts. Typical of useful polymeric film supports are films of cellulose nitrate and cellulose esters such as cellulose triacetate and diacetate, polystyrene, polyamides, homo- and co-polymers of vinyl chloride, poly(vinylacetal), polycarbonate, homo- and copolymers of olefins, such as polyethylene and polypropylene and polyesters of dibasic aromatic carboxylic acids with divalent alcohols, such as poly(ethylene terephthalate).

Polyester films, such as films of polyethylene terephthalate, have many advantageous properties, such as excellent strength and dimensional stability, which render them especially advantageous for use in the present invention.

The polyester film supports which can be advantageously employed in this invention are well known and widely used materials. Such film supports are typically prepared from high molecular weight polyesters derived by condensing a dihydric alcohol with a dibasic saturated fatty carboxylic acid or derivatives thereof. Suitable dihydric alcohols for use in preparing polyesters are well known in the art and include any glycol, wherein the hydroxyl groups are on the terminal carbon atom, containing from 2 to 12 carbon atoms such as, for example, ethylene glycol, propylene glycol, trimethylene glycol, hexamethylene glycol, decamethylene glycol, dodecamethylene glycol, and 1,4-cyclohexane dimethanol. Dibasic acids that can be employed in preparing polyesters are well known in the art and include those dibasic acids containing from 2 to 16 carbon atoms. Specific examples of suitable dibasic acids include adipic acid, sebacic acid, isophthalic acid, and terephthalic acid. The alkyl esters of the above-enumerated acids can also be employed satisfactorily. Other suitable dihydric alcohols and dibasic acids that can be employed in preparing polyesters from which sheeting can be prepared are described in J. W. Wellman, U.S. Pat. No. 2,720,503, issued Oct. 11, 1955.

Specific preferred examples of polyester resins which, in the form of sheeting, can be used in this invention are poly(ethylene terephthalate), poly(cyclohexane 1,4-dimethylene terephthalate), and the polyester derived by reacting 0.83 mol of dimethyl terephthalate, 0.17 mol of dimethyl isophthalate and at least one mol of 1,4-cyclohexanedimethanol. U.S. Pat. No. 2,901,466 discloses polyesters prepared from 1,4-cyclohexanedimethanol and their method of preparation.

In a typical process for the manufacture of a polyester photographic film support, the polyester is melt extruded through a slit die, quenched to the amorphous state, oriented by transverse and longitudinal stretching, and heat set under dimensional restraint. In addition to being directionally oriented and heat set, the polyester film can also be subjected to a subsequent heat relax treatment to provide still further improvement in dimensional stability and surface smoothness.

The thickness of the polymeric film which is employed in carrying out this invention is an important consideration in achieving optimum performance. In utilizing the first form of the process, conventional film base having a thickness in the range of from about 0.1 to about 0.3 millimeters can be employed. In utilizing the second form of the process, a very thin polymeric film is utilized, i.e., film with a thickness in the range of from 0.002 to 0.04 millimeters. In the second form of the process, this very thin film is temporarily united with a release sheet to provide a composite element having a thickness sufficient to enable it to be coated in conventional photographic coating operations. An example of a suitable release sheet for this purpose is a silicone-coated polyethylene terephthalate sheet material with a thickness in the range of from about 0.1 to about 0.3 millimeters. In the second form of the process, the very thin polymeric film becomes a permanent part of the end product and, accordingly, it is desirable that it be as thin as practical in order not to impair the optical characteristics of the photographic plate.

Since its primary function is to protect the underlying adhesive layer from attack by processing solutions, the very thin polymeric film can be described as a "protective interlayer." To facilitate the coating operation, the thickness of the release sheet is preferably at least five times, and more preferably at least ten times, that of such protective interlayer.

The release layer which is utilized in certain embodiments of this invention can be composed of any suitable composition that provides the necessary release characteristics and does not adversely affect photographic characteristics. The use of release layers, also referred to as stripping layers, in photographic elements is well known. Useful materials for forming such layers include gum arabic, sodium alginate, pectin, cellulose acetate hydrogen phthalate, polyvinyl alcohol, hydroxyethyl cellulose, polymethacrylic acid, plasticized methyl cellulose, ethyl cellulose, methyl methacrylate and butyl methacrylate. An example of a particularly effective release layer is a layer comprising an organosiloxane. Particularly effective release layers can also be prepared from a mixture of gelatin and a cellulose ether. Useful cellulose ethers for this purpose include methyl cellulose, ethyl cellulose, hydroxyethyl cellulose and hydroxypropyl cellulose. A suitable dry thickness for the release layer is in the range of from about 0.25 to about 2.5 micrometers and more preferably in the range of from about 0.5 to about 1.5 micrometers.

The release layer is designed to have greater adhesion to the flexible polymeric film than to the protective overcoat layer, whereby the film and release layer can be stripped off prior to the plate being put into use.

As an alternative to the use of a release layer, a flexible polymeric film having a release surface can be utilized. This can be achieved by appropriate selection of the polymer which is utilized in forming the flexible polymeric film. Alternatively, control of the degree of release can be achieved by suitably activating the surface of a polymeric film by well-known processes such as corona discharge treatment. Other methods of activating the surface of polymeric films are also well known in the art, including various chemical treatments and flame treatment. A suitable process of flame treatment is described in U.S. Pat. No. 3,072,483, while corona discharge treatment is described in numerous patents, including British Patents 971,058 and 1,060,526 and U.S. Pat. Nos. 2,864,755, 3,117,865, 3,220,842, 3,411,910, 3,531,314, 4,298,440 and 4,649,097. Methods of chemical treatment are described in U.S. Pat. Nos. 2,893,896, 3,419,410 and 3,740,252.

In activating the surface, the receptivity of the surface to coatings applied thereto is modified to provide a balance between the need for sufficient adhesion to facilitate transport and handling in finishing operations and sufficient release to permit stripping and transfer.

Activation of a polyester film is preferably carried out in accordance with this invention by the action of corona discharge. The corona discharge applied to the polyester surface can be supplied by well-known power sources. The spark-gap-type power source for the corona has current applied to the electrodes by a spark-gap excited oscillator in a well-known manner. Variation in fundamental frequency of the corona is obtained by changing the primary power frequency of the oscillator in a range up to 10,000 or more cycles per second. A high-voltage corona is desirable, e.g., 25,000 to 50,000 peak volts or higher. Voltages of this range are adequate for corona activation of polyesters at web speeds of several hundred meters per minute.

The corona can be applied to the polyester surface, for example, by means of several metal electrodes positioned close to the surface at a point where the surface is passing over a grounded metal roller coated with a dielectric. Similarly, a metal roller may be used to support the web with the other electrode array being in planatary disposition equidistant from the surface of the metal roller and each being coated with a dielectric, at least on the surface nearest the metal roller. The spacing of the electrodes to the polyester surface and ground roll should be adequate to produce the corona at the voltage used and yet allow for free passage of the sheet through the activating zone. Corona supplied by AC current, or a combination of AC superimposed on DC can be used.

The photographic elements of this invention can be black-and-white elements, color elements adapted for use in a negative-positive process, or color elements adapted for use in a reversal process. The silver halide emulsion layer can comprise any of the photographically useful silver halides such as silver chloride, silver bromide, silver iodide, silver chlorobromide, silver chloroiodide, silver bromoiodide and silver chlorobromoiodide.

Silver halide emulsions contain a hydrophilic colloid that serves as a binder or vehicle. The hydrophilic colloid is preferably gelatin, but many other suitable hydrophilic colloids are also known to the photographic art and can be used alone or in combination with gelatin. Suitable hydrophilic colloids include naturally occurring substances such as proteins, protein derivatives, cellulose derivatives—e.g., cellulose esters, gelatin—e.g., alkali-treated gelatin (cattle bone or hide gelatin) or acid-treated gelatin (pigskin gelatin), gelatin derivatives—e.g., acetylated gelatin, phthalated gelatin and the like, polysaccharides such as dextran, gum arabic, zein, casein, pectin, collagen derivatives, collodion, agaragar, arrowroot, albumin, and the like.

The silver halide emulsion layer utilized in this invention typically has a thickness in the range of from about 1.5 to about 4 micrometers and preferably in the range of from about 2 to about 3 micrometers.

As indicated hereinabove, a protective overcoat layer can be included in the photographic glass plates of this invention. The function of the protective overcoat layer is to provide protection against abrasion, scratching, fingerprints, and the like. The protective overcoat layer is comprised of gelatin or other suitable hydrophilic colloid and typically contains other ingredients such as surfactants and hardening agents. A particularly useful hardening agent is bis(vinylsulfonylmethyl) ether. The protective overcoat layer can also contain a matting agent which can be of either an organic or inorganic type. Examples of organic matting agents are particles, typically in the form of beads, of polymers such as polymeric esters of acrylic and methacrylic acid, e.g., poly(methyl methacrylate), cellulose esters such as cellulose acetate propionate, cellulose ethers, ethyl cellulose, polyvinyl resins such as poly(vinyl acetate), styrene polymers and copolymers, and the like. Examples of inorganic matting agents are particles of glass, silicon dioxide, titanium dioxide, magnesium oxide, aluminum oxide, barium sulfate, calcium carbonate, and the like. Matting agents and the way they are used in photographic elements are further described in U.S. Pat. Nos. 3,411,907 and 3,754,924.

The protective overcoat layer utilized in this invention typically has a thickness in the range of from about 0.2 to about 1 micrometers and preferably in the range of from about 0.4 to about 0.7 micrometers.

Antihalation layers are usefully incorporated in the photographic elements of this invention. Such layers contain a dye or pigment dispersed in a suitable binder, such as gelatin, and function to prevent light from being reflected into the silver halide emulsion layer and thereby cause an undesired spreading of the image which is known as halation. In addition to the dye or pigment and binder, they typically also contain a surfactant. Hydrophilic colloids described hereinabove as being useful in the silver halide emulsion layer are also useful as binders in the antihalation layer.

Dyes which are useful in the antihalation layer can be essentially any dye that is useful as a photographic filter dye. These dyes include oxonols, cyanines, merocyanines, arylidenes and the like. The filter dyes may be diffusible or non-diffusible, but are preferably solubilizable during photographic processing for decolorization and/or removal. Water soluble dyes may be used for this purpose. Such dyes are incorporated in the photographic element with a mordant to prevent dye wandering prior to photographic processing. Useful dyes include the pyrazolone oxonol dyes of U.S. Pat. No. 2,274,782, the solubilized diaryl azo dyes of U.S. Pat. No. 2,956,879, the solubilized styryl and butadienyl dyes of U.S. Pat. Nos. 3,423,207 and 3,384,487, the merocyanine dyes of U.S. Pat. No. 2,527,583, the merocyanine and oxonol dyes of U.S. Pat. Nos. 3,486,897, 3,652,284, and 3,718,472, the enamino hemioxonol dyes of U.S. Pat. No. 3,976,661, as well as ultraviolet absorbers, such as the cyanomethyl sulfone-derived merocyanines of U.S. Pat. No. 3,723,154, the thiazolidones, benzotriazoles, and thiazolothiazoles of U.S. Pat. Nos. 2,739,888, 3,253,921, 3,250,617, and 2,739,971, the triazoles of U.S. Pat. No. 3,004,896, and the hemioxonols of U.S. Pat. Nos. 3,215,597 and 4,045,229. Useful mordants are described, for example, in U.S. Pat. Nos. 3,282,699, 3,455,693, 3,438,779, and 3,795,519.

In a preferred embodiment of this invention, the filter dyes are solid particle dispersion filter dyes, as described in U.S. Pat. No. 4,092,168 and PCT Publication No. WO88/04794, the disclosures of which are incorporated herein by reference. Such dyes can be described by the formula:

$$[D-(A)_y]-X_n \quad (I)$$

where D is a chromophoric light-absorbing moiety, which may or may not comprise an aromatic ring if y is not 0 and which comprises an aromatic ring if y is 0, A is an aromatic ring bonded directly or indirectly to D, X is a substituent, either on A or on an aromatic ring portion of D, with an ionizable proton, y is 0 to 4, and n is 1 to 7, where the dye is substantially aqueous insoluble at a pH of 6 or below and substantially aqueous soluble at a pH of 8 or above. In dyes according to formula (I), X preferably has a pKa of 4 to 11 in a 50/50 volume basis mixture of ethanol and water. The dyes according to formula (I) also preferably have a log partition coefficient (log P) of from 0 to 6 when X is in unionized form.

Solid particle dispersion dyes according to formula (I) offer the advantage of being insoluble and non-diffusible in photographic elements at coating pH's, but soluble for decolorization and/or removal at photographic processing pH's. This is especially advantageous in the photographic elements of the present invention, which have at least one filter dye in an antihalation layer disposed on the same side of the glass plate support as the silver halide emulsion layer. Mordanted soluble dyes in such a layer can be difficult to remove or decolorize during photographic processing, and unmordanted soluble dyes wander to other layers of the element, adversely affecting the sensitometric properties of the emulsion layer(s).

Examples of filter dyes according to formula (I) include the following:

(1)

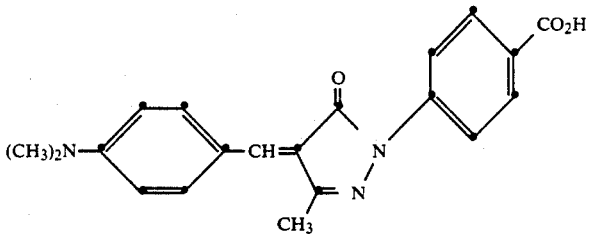

(2)

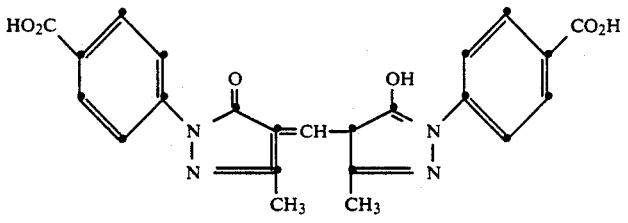

(3)

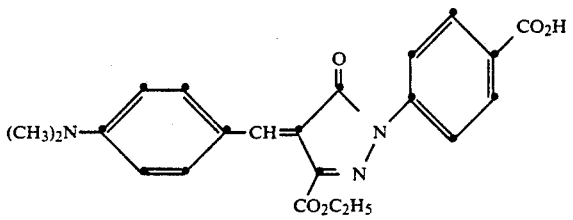

-continued

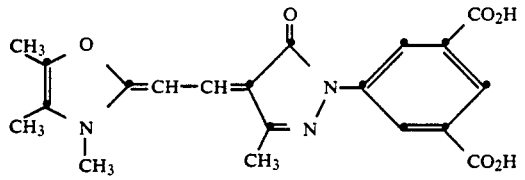

4)

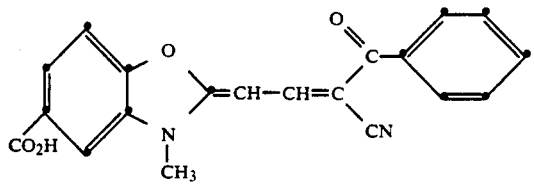

(5)

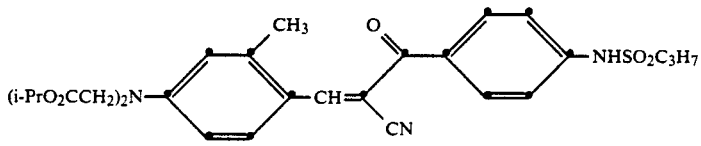

(6)

Other dyes according to formula (I) are described in the above-referenced U.S. Pat. No. 4,092,168 and WO 8/04794. The use of solid particle dyes in antihalation layers or other layers of photographic elements is also described in European Patent Application No. 0391405, published Oct. 10, 1990.

The antihalation layer utilized in the photographic glass plates of this invention typically has a thickness in the range of from about 0.2 to about 1 micrometers and preferably in the range of from about 0.4 to about 0.7 micrometers.

In the practice of this invention, the element comprising the photographic layers is laminated to the glass plate using suitable well-known laminating techniques such as the use of deformable pressure rollers. The element containing the photographic layers is typically utilized in roll form so that both laminating and chopping operations, and, in some instances, trimming operations, are required to produce the finished product.

The invention is further illustrated by the following example of its practice.

A photographic film base composed of biaxially oriented heat-set and heat-relaxed poly(ethylene terephthalate) with a thickness of 0.1 millimeters was coated with the following layers in the order indicated:

(1) a release layer having a thickness of 0.75 micrometers composed of hydroxyethyl cellulose;

(2) a protective overcoat layer having a thickness of 0.45 micrometers composed of gelatin and containing 0.02 parts per part by weight of gelatin of the hardening agent bis(vinylsulfonylmethyl)ether;

(3) a silver halide emulsion layer having a thickness of 3.2 micrometers composed of a black-and-white silver halide emulsion as described in Example 1 of U.S. Pat. No. 4,933,272; and (4) an antihalation layer having a thickness of 0.45 micrometers composed of gelatin, a surfactant and 0.1 parts per part by weight of gelatin of the solid particle dye 1-(4-carboxyphenyl)-4-(4-dimethylamino benzylidene)-3-methyl-2-pyrazolin-5-one.

A glass plate having a thickness of 6.4 millimeters and a highly polished surface was coated with an adhesive composition comprised of 18% by weight GANTREX AN-119 copolymer, 12% by weight glycerol and 70% by weight water. The adhesive composition was applied in an amount sufficient to provide a dry thickness of 9 micrometers.

After drying the adhesive layer, the poly(ethylene terephthalate) film was laminated to the glass plate using a DuPont Hot Roll Laminator HRL-24 so that the antihalation layer was in contact with the adhesive layer. The poly(ethylene terephthalate) film and adherent release layer was then stripped off and the photographic glass plate was imagewise exposed and processed in the conventional manner.

The photographic glass plates of this invention can incorporate various agents not specifically described hereinabove. For example, the protective overcoat layer can contain lubricants and filter dyes, the emulsion layer can contain nucleating agents, and latex polymers can be included in any of the layers.

In comparison with conventional photographic glass plates, those manufactured by the techniques described herein have many advantages. For example, they have fewer coating defects since it is much easier to carry out defect-free coating of a flexible support material than to carry out defect-free coating of a rigid glass plate. They are also more economical to manufacture since a flexible support material can be successfully coated at much higher speeds than a rigid glass plate. The lamination techniques of this invention also provide a high degree of operational flexibility that facilitates the manufacture of a broad line of photographic glass plates differing in such features as size, thickness and emulsion type. By use of the method of this invention, it is now feasible to manufacture large format glass plates whose production has previously been impractical.

The invention has been described in detail with particular reference to preferred embodiments thereof, but it will be understood that variations and modifications can be effected within the spirit and scope of the invention.

We claim:

1. A photographic element comprised of a series of layers interposed between a rigid glass plate and a flexible polymeric film, said series of layers comprising, in order:

(1) an adhesive layer in contact with said glass plate,
(2) an antihalation layer,
(3) a silver halide emulsion layer,
(4) a protective overcoat layer and
(5) a release layer in contact with said protective overcoat layer and with said flexible polymeric film; said release layer having greater adhesion to said flexible polymeric film than to said protective overcoat layer to thereby permit said flexible polymeric film to be stripped from said photographic element.

2. A photographic element as claimed in claim 1, wherein said flexible polymeric film is a polyester film.

3. A photographic element as claimed in claim 1, wherein said flexible polymeric film is composed of polyethylene terephthalate.

4. A photographic element as claimed in claim 1, wherein said adhesive layer is a layer of pressure-sensitive adhesive.

5. A photographic element as claimed in claim 1, wherein said adhesive layer comprises a film-forming copolymer of methyl vinyl ether and maleic anhydride.

6. A photographic element as claimed in claim 1, wherein said antihalation layer comprises a solid particle dye dispersed in gelatin.

7. A photographic element as claimed in claim 1, wherein said release layer is comprised of a mixture of gelatin and a cellulose ether.

8. A photographic element as claimed in claim 1, wherein said rigid glass plate has a thickness in the range of from about 1 to about 10 millimeters, said flexible polymeric film has a thickness in the range of from about 0.1 to about 0.3 millimeters, said adhesive layer has a thickness in the range of from about 2 to about 25 micrometers, said antihalation layer has a thickness in the range of from about 0.2 to about 1 micrometers, said silver halide emulsion layer has a thickness in the range of from about 1.5 to about 4 micrometers, said protective overcoat layer has a thickness in the range of from about 0.2 to about 1 micrometers, and said release layer has a thickness in the range of from about 0.25 to about 2.5 micrometers.

9. A photographic element as claimed in claim 8, wherein said flexible polymeric film is a polyethylene terephthalate film, said adhesive layer comprises a water-soluble, film-forming copolymer of methyl vinyl ether and maleic anhydride, said antihalation layer comprises a solid particle dye dispersed in gelatin, said silver halide emulsion layer is a black-and-white emulsion comprising silver halide grains and gelatin, said protective overcoat layer is comprised of gelatin, and said release layer is comprised of a mixture of gelatin and hydroxyethyl cellulose.

10. A photographic element useful as a means of transferring a multilayer composite to a rigid glass plate support in the manufacture of a radiation-sensitive photographic glass plate; said element comprising a flexible polymeric film bearing on one surface thereof a multilayer composite comprising, in order:
(1) a release layer,
(2) a protective overcoat layer,
(3) a silver halide emulsion layer, and
(4) an antihalation layer;
said release layer being in contact with said flexible polymeric film and with said protective overcoat layer and having greater adhesion to said flexible polymeric film than to said protective overcoat layer, whereby said flexible polymeric film and adherent release layer can be stripped from said protective overcoat layer after said element has been laminated to said rigid glass plate support.

11. A photographic element as claimed in claim 10, wherein said flexible polymeric film is composed of polyethylene terephthalate, said release layer is comprised of a mixture of gelatin and hydroxyethyl cellulose, said protective overcoat layer and said silver halide emulsion layer both contain gelatin, and said antihalation layer comprises a solid particle dye dispersed in gelatin.

* * * * *